US005377882A

United States Patent [19]

Pham et al.

[11] Patent Number: 5,377,882

[45] Date of Patent: Jan. 3, 1995

[54] CONTAINER AND CLOSURE

[76] Inventors: Ninh G. Pham, #511, 2401 W. Sam Houston Pkwy., Houston, Tex. 77043; Joseph A. Decker, Jr., 22331 Joshua Kendell, Katy, Tex. 77449; Canh S. Bui, 1578 King Stream Cir., Herndon, Va. 22070

[21] Appl. No.: 93,394

[22] Filed: Jul. 19, 1993

Related U.S. Application Data

[63] Continuation-in-part of Ser. No. 870,884, Apr. 20, 1992, Pat. No. 5,228,603, which is a continuation-in-part of Ser. No. 576,800, Sep. 4, 1990, Pat. No. 5,105,986.

[51] Int. Cl.[6] ..... B67D 3/00

[52] U.S. Cl. ..... 222/479; 222/484; 222/491; 222/517; 222/556

[58] Field of Search ..... 222/479, 511, 517, 556, 222/562, 484, 537, 491, 564

[56] References Cited

U.S. PATENT DOCUMENTS

| | | | |
|---|---|---|---|
| 756,586 | 4/1904 | Clements | 222/556 |
| 1,100,536 | 6/1914 | Clarke | 222/564 |
| 1,120,313 | 12/1914 | Kessler | 222/517 |
| 1,214,000 | 2/1917 | Silverthorne | 222/556 X |
| 1,253,579 | 1/1918 | Deanes | 222/464 |
| 1,279,667 | 9/1918 | Davis | 215/309 |
| 1,344,516 | 6/1920 | Phillips | 215/310 |
| 1,419,829 | 6/1922 | Dowd | 222/491 |
| 1,472,046 | 10/1923 | Cantrell | 222/517 |
| 1,966,035 | 7/1934 | Jensen | 222/517 |
| 2,110,026 | 3/1938 | Rose | 215/309 |
| 2,701,078 | 2/1955 | Bowman | 222/511 |
| 3,059,816 | 10/1962 | Goldstein | 215/309 |
| 3,168,221 | 2/1965 | Parker | 222/556 X |
| 3,361,412 | 1/1968 | Cole, III | 239/432 |
| 3,412,902 | 11/1968 | Milner et al. | 222/145 |
| 3,506,167 | 4/1970 | Orr | 222/479 |
| 3,850,350 | 11/1974 | Towns et al. | 222/556 |
| 4,061,248 | 12/1977 | Arena | 239/432 |
| 4,607,768 | 9/1986 | Taber et al. | 222/517 |
| 4,726,091 | 2/1988 | Joyce | 222/239 |
| 4,782,985 | 11/1988 | Kinsley | 222/556 X |
| 4,789,082 | 12/1988 | Sampson | 222/491 |
| 4,901,892 | 2/1990 | Song | 222/556 X |
| 4,925,040 | 5/1990 | Wang | 222/464 X |
| 4,938,390 | 7/1990 | Markva | 222/494 |
| 5,105,986 | 4/1992 | Pham et al. | 222/479 X |
| 5,228,603 | 7/1993 | Pham et al. | 222/562 X |

FOREIGN PATENT DOCUMENTS

| | | | |
|---|---|---|---|
| 758578 | 1/1934 | France | 222/556 |
| 2174981 | 11/1986 | United Kingdom | 222/556 |

*Primary Examiner*—David M. Mitchell
*Assistant Examiner*—Kenneth Bomberg
*Attorney, Agent, or Firm*—Guy McClung

[57] ABSTRACT

The present invention, in one aspect, discloses a closure device for a container and a container with such a device. The device has a body with a top fluid pour opening and with a top air vent opening. Preferably the air vent extends through a vent extension which projects downwardly from the body. A hinged lid releasably seals the fluid pour opening shut and the air vent shut. The lid is held within a top recess over the two openings and is, in one preferred embodiment, releasable by squeezing a container on which the device is disposed.

13 Claims, 8 Drawing Sheets

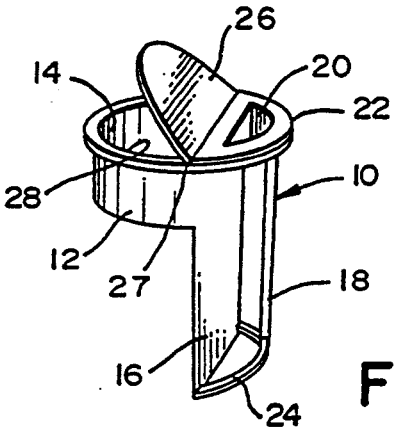
FIG. 1
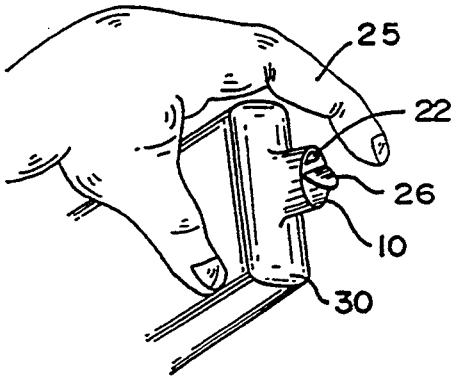
FIG. 2
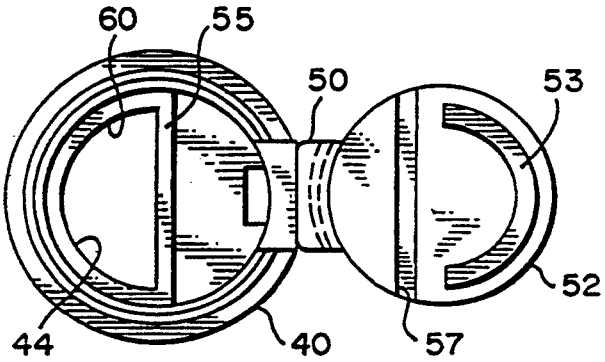
FIG. 3B
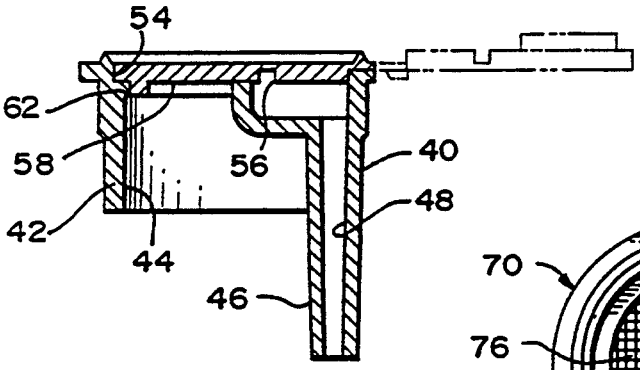
FIG. 3A
FIG. 4B
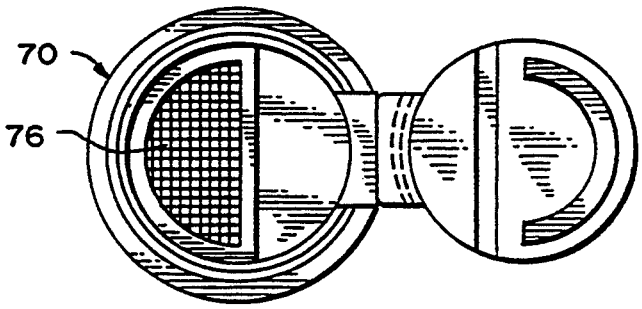
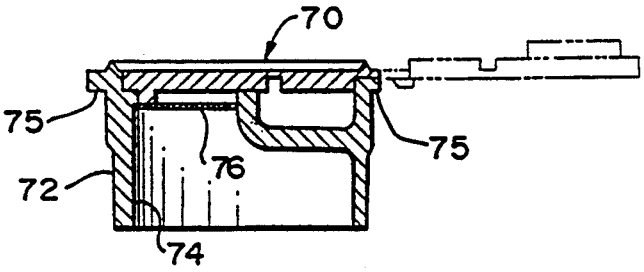
FIG. 4A

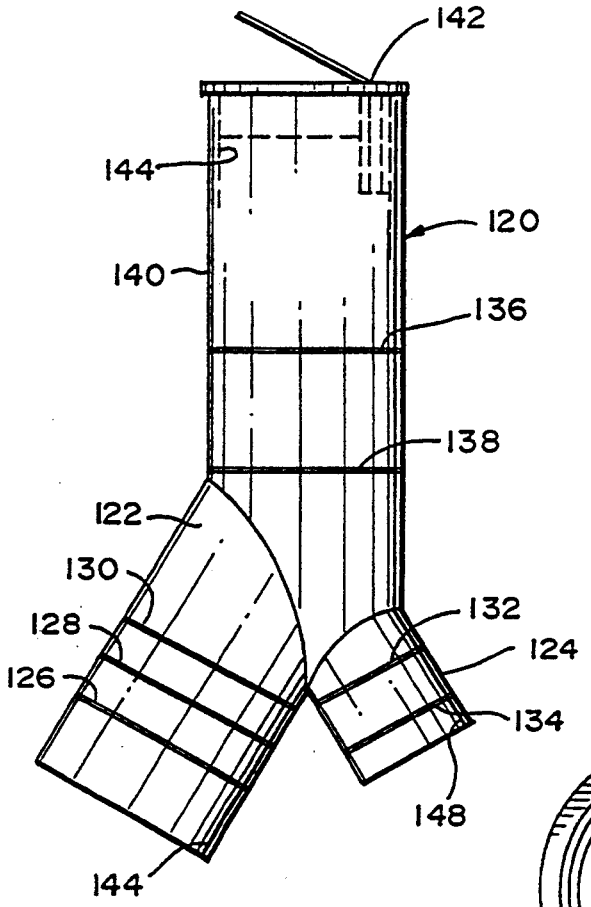
FIG. 7
FIG. 8
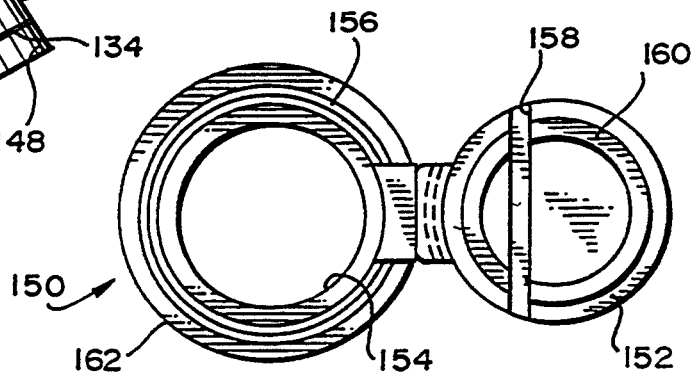
FIG. 9
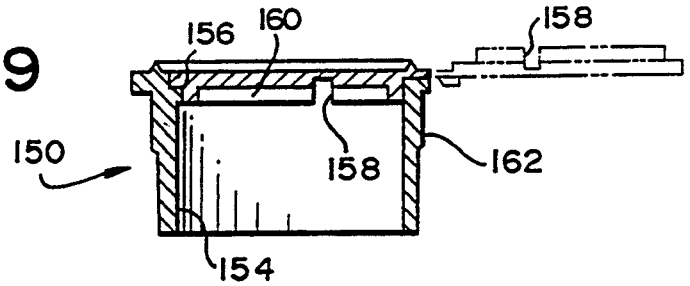
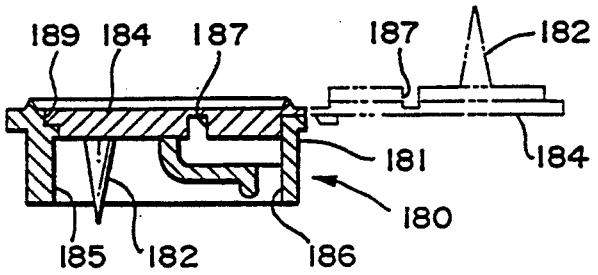
FIG. 10

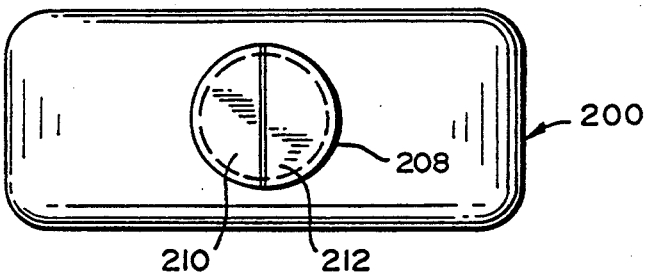
FIG. 11
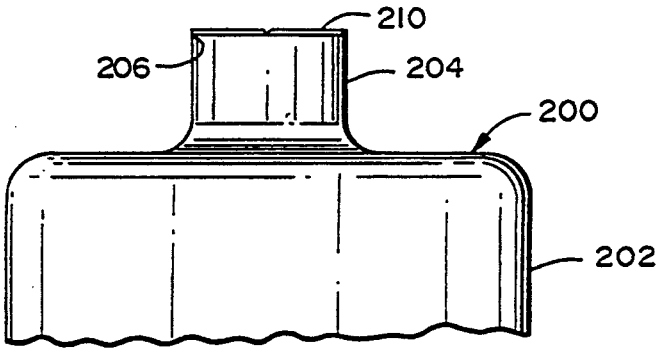
FIG. 12
FIG. 13
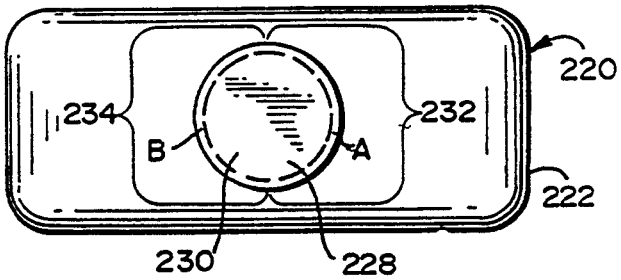
FIG. 14
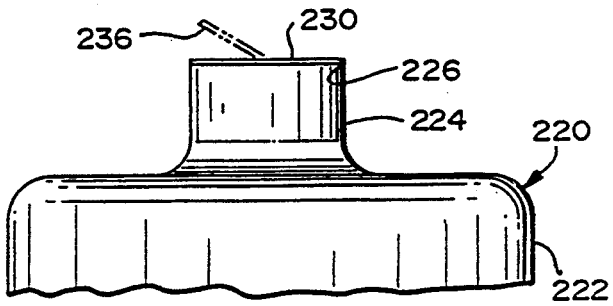
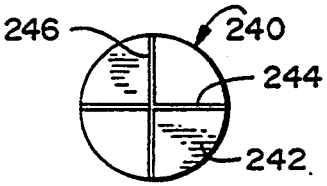
FIG. 15
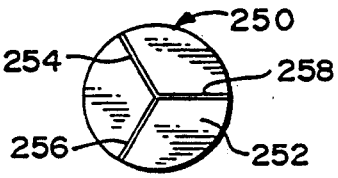
FIG. 16
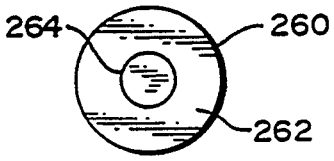
FIG. 17

CONTAINER AND CLOSURE

This application is a continuation-in-part of U.S. application Ser. No. 07/870,884 filed on Apr. 20, 1992 and issuing as U.S. Pat. No. 5,228,603 on Jul. 20, 1993. U.S. Pat. No. 5,228,603 is a continuation-in-part of Ser. No. 576,800, now U.S. Pat. No. 5,705,986 issued on Apr. 21, 1992 .

BACKGROUND OF THE INVENTION

1Field Of The Invention

This invention is directed to containers for liquids which are invertible with little or not spillage; to methods for pouring liquids from containers into spouts or openings; and, in particular embodiments to devices for use with liquid containers for minimizing or eliminating spillage of the contents of the container.

2. Description Of Related Art

Many situations require the partial or total inversion of a container of liquid prior to pouring the liquid into an opening, a spout, or another container; for example, adding oil to the crankcase of a car requires opening a container of oil and then pouring it into an opening or small spout on the crankcase's top. Even when a funnel or pouring spout is used, oil often spills onto the engine or the ground. Other similar situations include adding transmission fluid to a transmission fluid reservoir; adding antifreeze to a radiator; or adding ingredients to something to be cooked or baked.

Various machines for making foods, e.g. ice cream, require the inversion of a container, e.g. a milk bottle, above an opening in the machine. Spillage in such an operation can have many causes—e.g. the poor aim .of the person responsible for introducing the liquid into the opening or a mis-match between container and opening.

With prior art containers and devices, liquid flows as influenced by gravity (once the container is opened) and the person pouring the liquid cannot then control the moment when liquid starts to flow. Other prior art containers require puncturing or removal of a seal prior to discharging the container's contents.

Many of the liquids that are currently spilled in such operations are harmful to the environment.

In accordance with 37 C.F.R. §1.56, the following are disclosed:

U.S. Pat. No. 1,279,667 discloses a ream separator and bottle stopper with a rotatable closure plate for closing off two tubes that can extend into a milk bottle.

U.S. Pat. No. 1,344,516 discloses a bottle cap with a closure flap that engages a recess in the neck of a battle.

U.S. Pat. No. 1,419,829 discloses a combined dispensing and sealing bottle top which engages the exterior of a bottle's neck.

U.S. Pat. No. 2,110,026 discloses a pouring device for a container, the device having an air vent. This device specifically prevents closure of the container.

U.S. Pat. No. 3,059,816 discloses a combination closure and pouring device with an integral flexible strap connecting a hollow body member for encircling a container's neck and a cap, including a fluid opening and a vent opening.

There has long been a need for an invertible container of liquid which can be inverted with minimal spillage of the liquid. There has long been a need for an insert for existing containers which, when used with an existing container, minimizes or eliminates spillage of liquid when the container is inverted. There has long been a need for such a container and such an insert which can be activated at a desired moment by a person holding a container. There has long been a need for a method for introducing liquid into a spout or opening from an inverted container of liquid while minimizing or eliminating spillage of the liquid and with control over the moment when it is desired to start the liquid flow. There has long been a need for such containers, devices, and methods which reduce pollution and reduce endangerment of the environment.

SUMMARY OF THE INVENTION

The present invention, in one aspect, discloses a closure device for a container, and a container with such a device. The device has a body with a top fluid pour opening and with a top air vent opening. Preferably the air vent extends through a vent extension which projects downwardly from the body. A hinged lid releasably seals the fluid pour opening shut and the air vent shut. The lid is held within a top recess over the two openings and is, in one preferred embodiment, releasable by squeezing a container on which the device is disposed.

In one embodiment, the present invention is directed to a device securable to or within a container for liquid, the device having a main body member with a recess for receiving an upper spout or neck of the container and for securement thereto, therein, or therearound; the body having a channel therethrough through which liquid from the container may flow out; the body having a flap or closure movably secured, e.g. by a hinge, thereto which will move away from the opening to permit flow unless held to close off the opening by a thumb or finger of a person holding the container. In this embodiment, a person holds the container and also holds the flap or closure against the opening, e.g. with a thumb, as the container is inverted. Once the opening is over, adjacent, or within the spout, opening, or other container into which the liquid is to be introduced, the person removes her thumb, permitting liquid to flow with little or no unwanted spillage.

In another embodiment, such a device may have a separate channel that acts as an air vent to facilitate the flow of the liquid. The flap or closure can cover both channels or dual movable flaps may be employed, one for each channel, each flap permitting flow when pressure thereon is released.

For containers with no neck or spout, e.g. containers with an opening flush with the container's surface, the device can be fashioned and configured to be securable to and/or within such a flush opening. Also, in such a situation, the device can be designed with its own neck to provide also a pouring spout.

In another embodiment, a device according to this invention includes a piece of frangible material, e.g. paper, foam, or metal foil, secured permanently or semi-permanently over a container's opening to prevent flow. In one embodiment, the piece of frangible material can have a weak spot formed integrally of it, or a portion formed from a material which is easily frangible and a portion which is not. In another embodiment, a piece of material secured over the container's opening has a weakened a portion thereof so that upon inversion of the container either the force of the container's contents or a force exerted on the container by squeezing it (if it is squeezable), or a combination of both forces, causes the paper, foam or foil to break, permitting liquid to flow from the container. In another embodiment, a seal over a container's opening is made less secure at one area (e.g. less glue is used in one area around the periphery of the opening) so that squeezing the container pops the cover free in the less secure area allowing liquid to flow.

Flow from such containers and such devices may be inhibited or controlled by sizing channels as desired and/or by providing obstructions across channels, e.g., a screen or screens, a rib or an array of ribs. Obstructions, e.g., but not limited to a screen or an array of ribs or mesh, may also provide inhibition of flow or for filtering, straining or mixing of a liquid or of a multicomponent liquid. By providing multiple layers of such obstructions, more thorough filtering, straining or mixing can be achieved.

In another embodiment, a device is provided which can be secured to more than one container, either containers of the same liquid or containers of different liquids. With such an embodiment, mixing of components with obstructions as previously described may be very desirable.

In another embodiment, the flap or closure can be formed so that it may be pushed inwardly, e.g. by a person's thumb, to release a closure member, e.g. a bead on the flap resting in a corresponding recess on a body member. This would provide additional assurance that flow would not proceed until desired.

In embodiments for use with containers which have a frangible cover installed over an opening, a projection can be provided on a flap or closure according to the present invention for puncturing such cover or separating it partially from being secured around the periphery of an opening prior to or after inversion of the container, further minimizing the danger of spillage.

Methods are provided for using the various devices taught by this invention to prevent or minimize unwanted spillage from inverted containers of liquid.

It is, therefore, an object of this invention to provide new, unique, efficient, effective, creatively simple, and nonobvious containers, devices, and methods for minimizing or preventing unwanted spillage from partially or entirely inverted containers.

Another object of this invention is the provision of such devices, containers, and methods which give a person control over the moment at which it is desired to begin the flow of liquid from an inverted container.

Yet another object of the present invention is the provision of such devices, containers and methods using them which devices and containers have an air channel therein to facilitate the flow of liquid from the container.

Another object of the present invention is the provision of such devices and containers, and methods using them, which include a closure for each channel.

A further object of the present invention is the provision of: a device having a closure which blocks off flow so long as pressure is applied to the closure, but which, upon release of such pressure, permits flow; a container with such a device; and methods employing such devices and containers.

An additional object of the present invention is the provision of a closure which is semi-permanently held in place on a body member preventing flow until it is pressed inwardly, releasing the closure and permitting the flow.

Another object of the present invention is the provision of: such devices with a neck or spout portion as desired; containers with such characteristics; and methods using them.

Yet another object of the present invention is the provision of: such devices which can be communicatively connected to more than one container so that liquid from each of the more than one containers flows together within and then through the device; containers with such aspects; and methods using them.

A further object of the present invention is the provision of flow controllers, filters, and/or mixing apparatus in any of the previously described devices or containers or used in any of the previously described methods.

Another object of the present invention is the provision of a container according to this invention having a closure device according to this invention with a flow opening sized to receive a straw or similar item and to permit the straw to rise within the container when the closure member is opened; and in one aspect to such a container with a straw with a flotation aid thereon.

An additional object of the present invention is the provision of a device on the flap or closure of any of the previously described devices or containers for breaking or severing a cover over an opening of a container or for separating a portion of the cover from its securement about an opening.

Another object of the present invention is the provision of a device and of a container with such a device which has a member that releasably seals openings in the device and which is releasable by squeezing the container.

The present invention recognizes and addresses the previously-mentioned long-felt needs and provides a satisfactory meeting of those needs in its various possible embodiments. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part a part of this specification. It is to be noted, however, that the appended drawings illustrate preferred embodiments of the invention and are therefore not to be considered limiting of its scope, for the invention may admit to other equally effective equivalent embodiments.

FIG. 1 is a perspective view of a device according to the present invention.

FIG. 2 is a perspective view of a container according to the present invention.

FIG. 3A is a cross-sectional side view of a device according to the present invention.

FIG. 3B is a top view of the device of FIG. 3A.

FIG. 4A is a cross-sectional side view of a device according to the present invention.

FIG. 4B is a top view of the device of FIG. 4A.

FIG. 7 is a side view of a device according to the present invention.

FIG. 8 is a top view of a device according to the present invention.

FIG. 9 is a side view of the device of FIG. 8.

FIGS. 10 is a cross-sectional view of a device according to the present invention.

FIG. 11 is a top view of a container according to the present invention.

FIG. 12 is a side view of the container of FIG. 11.

FIG. 13 is a top view of a container according to the present invention.

FIG. 14 is a side view of the container of FIG. 13.

FIG. 15 is a top view of a closure member according to the present invention.

FIG. 16 is a top view of a closure member according to the present invention.

FIG. 17 is a top view of a closure member according to the present invention.

DESCRIPTION OF EMBODIMENTS PREFERRED AT THE TIME OF FILING FORT HIS PATENT

Figure 5:
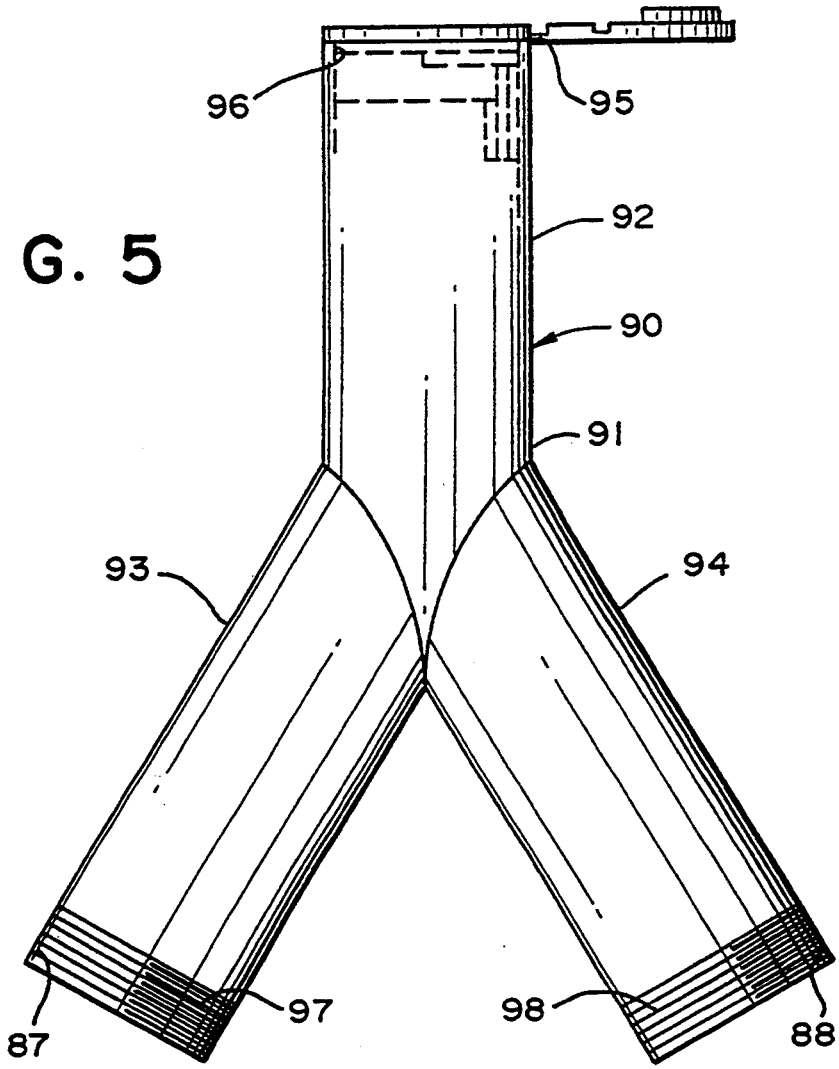
FIG. 5 is a side view of a device according to the present invention.

Referring now to FIG. 1, a device 10 according to the present invention has a body 12 fashioned to sealingly be received in or to receive a part of a container (not shown) such as its neck with a opening therein. The body 12 has a fluid chapel 14 therethrough that will communicate with a fluid opening in the container when the device 10 is connected to the container. An elongated portion 16 of the body 12 coupled with a strut 18 and a semicircular member 24 form an air flow path that communicates with an air channel 20 in the body 12. In the embodiment shown in FIG. 1, there is no closure member adjacent an opening 22 of the air channel 20, but a person's finger or thumb can easily shut off the opening 22. A closure flap 26 is movably connected to the body 12, by a hinge 27, e.g. a "living" hinge, so that the closure flap 26 is not held sealingly over an opening 28 of the fluid channel 14 unless pressure is applied to it, e.g. by a person's finger or thumb, as shown in FIG. 2. The device 10, for use with petroleum based liquids is preferably made of polyethylene, e.g. linear low density polyethylene. For use with containers of foods, foodstuffs, or beverages, it is preferably made from polyethylene or polyethylene terephthalate (PET).

As shown in FIG. 2, a squeezable plastic oil bottle 30 according to the present invention has a device 10 and a person's finger 25 can hold the flap 26 sealingly over a fluid channel of the device while the person holds the container 30. The finger can also close off the opening 22.

FIGS. 3A and 3B illustrate a device 40 according to the present invention having a body 42 which is configured to be sealingly secured about an opening in a neck-,of a liquid container (not shown) or received sealingly therein. A fluid channel 44 through the body 42 is disposed to communicate with the opening of the liquid container to permit the flow of liquid from the container. In an elongated portion 46 of the device 40, an air channel 48 is provided to facilitate the flow of liquid from the container upon inverting the container partially (less than 180°) or entirely (180°). With a living hinge 50 a closure flap 52 is hingedly secured to the body 42 so that, upon receipt of the flap 52 in a groove 54 and in contact with a ridge 62 of the body 42, the fluid channel 44 and the air channel 48 are sealingly closed off to flow therethrough. Held by a sealing press fit in the opening 60, is a curved ridge 53. A ridge 55 is sealingly received in a recess 57 by a sealing press fit. Easily releasable bead-recess combinations can be used to enhance these sealing closures, with the bead on one portion and the recess on another. Thus each channel 44 and 48 can be sealingly, yet easily openably, closed to fluid flow. An open position of the flap 52 is shown in dotted lines in FIG. 3A. A recess 56 in an underside 58 of the flap 52 provides an area which can easily be pushed inwardly (downwardly in FIG. 3A) to pop the flap 52 free of the groove 54 and ridge 62 and thereby open the channels to flow therethrough. This can be done by a person holding a container with a device 40 with one hand when an opening 60 of the fluid channel 44 is adjacent or in an opening or spout into which liquid from the container is to be fed. Protrusion 59 is receivable in recess 61 to effectively seal off flow through the channel 48.

FIG. 4A and 4B illustrate a device 70 according to the present invention which has a body 72 with a hollow channel portion 74 which can be sealingly received in an opening and sealingly be secured about a neck or other member with an opening of a container of liquid. If the device 70 is received in an opening of a container, shoulders 75 facilitate positioning of the device in the opening. The device 70 is like the device 40 and also includes a mesh screen 76 across the channel 74 (like the channel 44). The mesh screen 76 can provide a variety of functions—flow inhibition, straining, filtering, and-/or mixing. It is within the scope of this invention to locate such a screen at any point in the fluid channel and to use multiple screens of either the same or different mesh. It is also within the scope of this invention to use an obstruction, a solid member or members, a rib, ribs, or any array of ribs or solid members across the fluid channel to achieve the functions of flow inhibition, mixing or filtering, FIG. 5 shows a device 90 according to the present invention which has a hollow body 91 with a hollow neck 92 and two hollow arms 93 and 94, all in fluid intercomanunication. A device 95 (like the device 10) is disposed in an opening 96 at the top of the neck 92. As shown, external threads 97 and 98 at openings 87 and 88 of the arms 93 and 94, respectively, permit two separate containers with corresponding interior threads on spouts, openings, or necks thereof to be connected to the device 90 so that the contents of two containers may be introduced through the hollow neck 92, through its opening 96, and through the device 90 into another container, spout, or opening of a container. FIG. 5 is illustrative of an embodiment of the present invention useful with two containers and is meant to illustrate that devices with an appropriate number of hollow arms can be made according to the present invention for more than one (i.e., 2, 3, 4, . . . etc.) container. In this way, time may be saved and/or containers with different contents may be simultaneously emptied. Although exterior threads are shown for mating with interior threads of containers, the threads on the device could be on its interior to mate with exterior threads of another member; or the device's opening may be fashioned for a sealing press fit without the use of threads.

Figure 6:
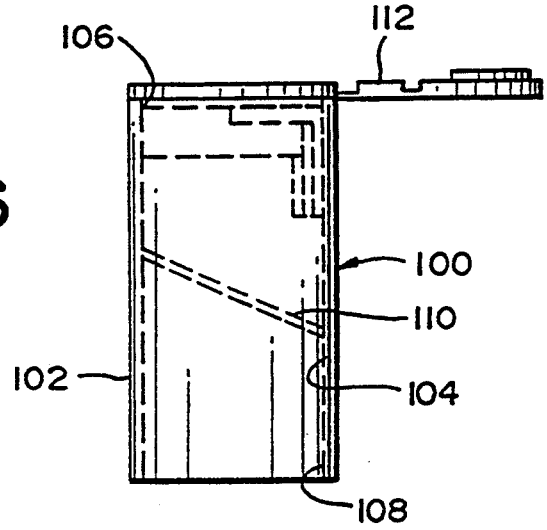
FIG. 6 is a side view of a device according to the present invention.

As shown in FIG. 6, an apparatus 100 according to the present invention has a hollow body 102 with a liquid channel 104 therethrough, a top opening 106, and a bottom opening 108. A screen 110 is disposed at an angle across the channel 104 for mixing and/or filtering liquid or liquids flowing through the apparatus 100. A device 112 (like the device 10) is disposed in the opening 106 and the top of the channel 104. A neck or spout of a liquid container (not shown) can be sealingly inserted into the bottom opening 108 (or the bottom of the hollow body can be sealingly inserted into a spout or opening of a container).

An apparatus 120 according to the present invention is shown in FIG. 7. It is similar to the device 90 of FIG. 5, but it has two hollow arms 122 and 124 of different size. Also, there are multiple screens 126, 128, 130 in the arm 122; screens 132, 134 in the arm 124; and screen 136, 138 in a hollow neck 140 of the apparatus 120. A device 142 (like the device 10) is disposed in a top opening 144 of the neck 140. Liquid from a container (not shown) attached to an opening 146 in the arm 122 flows, upon inversion of the apparatus, into the arm 122; through the screens 126, 128, 130; into the hollow neck 140; through the opening 144 and out the device 142. Similarly, liquid from a container (not shown) attached to an opening 148 in the arm 124, flows, upon inversion of the containers and the apparatus, into the arm 124; through the screens 132 and 134; into the hollow neck 140 mixing with the liquid from the arm 122; through the neck 140; through the opening 144; and out through the device 142.

Referring now to FIGS. 8 and 9, an apparatus 150 according to the present invention has in a body 162 a channel 154 for fluid flow therethrough which is sealingly closable by a flap 152 received in an open groove 156. A recess 158 in the flap 152 facilitates pushing the flap 152 inwardly of the channel 154 to release a circular ridge 160 held by a sealing press fit in the groove 156. The flap is shown in open position in dotted lines.

Referring now to FIG. 10, a device 180 according to the present invention is like the device 40 (FIG. 3A); but the device 180 has a projection 182 extending from a closure flap 184 for puncturing a seal across an opening of a container with which the device 180 is to be used. In this manner, the seal does not need to be broken, removed, or punctured prior to use of the device 180. It is within the scope of this invention to use a projection of a different configuration or size and to use multiple projections. An air channel 186 in a body 181 of the device 180 is shorter than the air channel in the device 40 (FIG. 3A). Fluid flows through a fluid channel 185 upon release of a flap 184 from its sealing press fit closure position in a groove 189 (facilitated by pushing inwardly due to a recess 187 in the flap 184).

FIGS. 11 and 12 present a squeezable liquid container 200 according to the present invention made, e.g. from flexible plastic and having a main hollow body 202 with a hollow neck 204 in fluid communication with the interior of the body 202. An opening 206 at the top of the neck 204 has an edge 208 to which is glued a closure cover 210 which seals shut the opening 206. A line indentation 212 across the cover 210 provides a line along which the cover 210 will break upon squeezing of the container 200. Thus, the neck 204 can be inserted into an opening of another container or vessel while the cover 210 is still inplace and the container 200 can be squeezed, breaking the cover 210 and allowing liquid in the container to flow out.

Referring now to FIGS. 13 and 14, a squeezable liquid container 220 according to the present invention has a main hollow body 222 with a hollow neck 224 communicating with the body 222. An opening 226 at the top of the neck has an edge 228 around it. In a first area 232 of the edge 228 an amount of glue A is used to secure a cover 230 to the edge 228. In a second area 234 of the edge 228 a lesser amount of glue B is used so that upon squeezing of the container 220 the cover separates from the edge 228 in the area 234 thereby permitting liquid to flow out of the container. As shown in dotted lines in FIG. 14, a portion 236 of the cover 230 has separated from the edge 228 in the area 234 to permit liquid flow from the container 220.

FIGS. 15 and 16 present frangible sealing covers for liquid container openings according to the present invention. In FIG. 15, cover 240 has a main body 242 with crossed indentations 244 and 246 which facilitate breaking of the cover either by puncturing from outside or by pressure from inside caused by squeezing a container with such a cover over its opening. In FIG. 16, the cover 250 has a main body 252 and three indentation lines 254, 256, and 258.

FIG. 17 presents a frangible cover 260 according to the present invention for sealing shut an opening of a container of liquid having a first portion 262 made from one material and a second portion 264 secured to the first portion 262 and made from an easily broken material which can be easily punctured or easily broken by squeezing a squeezable container sealed shut by such a cover.

Figure 18A:
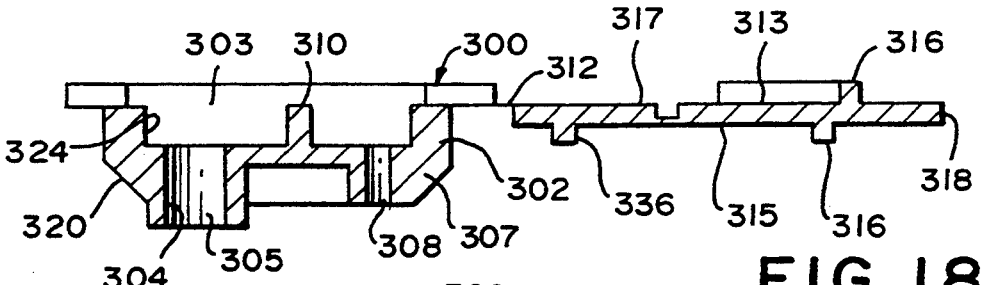
FIG. 18A is a side view in cross-section of a closure member according to the present invention.
Figure 18B:
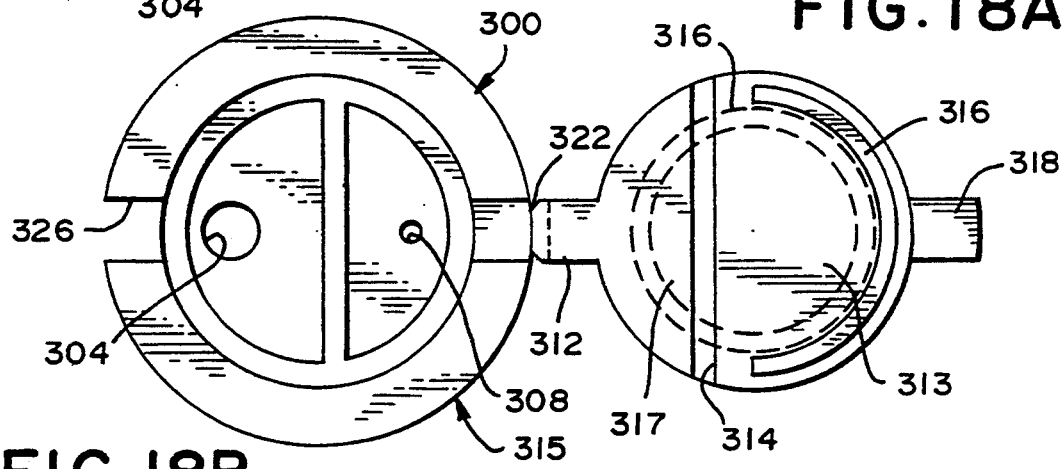
FIG. 18B is a top view of the closure member of FIG. 18A.
Figure 19:
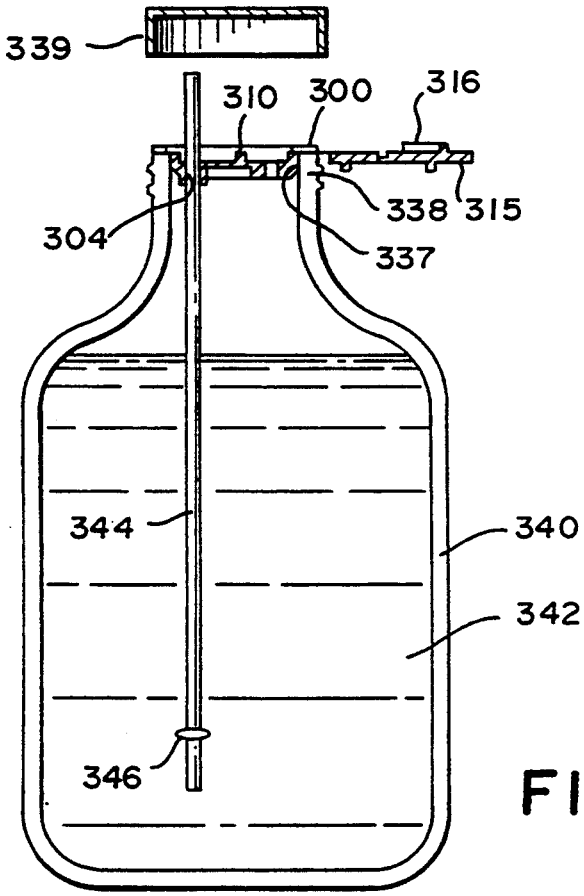
FIG. 19 shows the closure member of FIG. 18A disposed on a liquid container.
Figure 20:
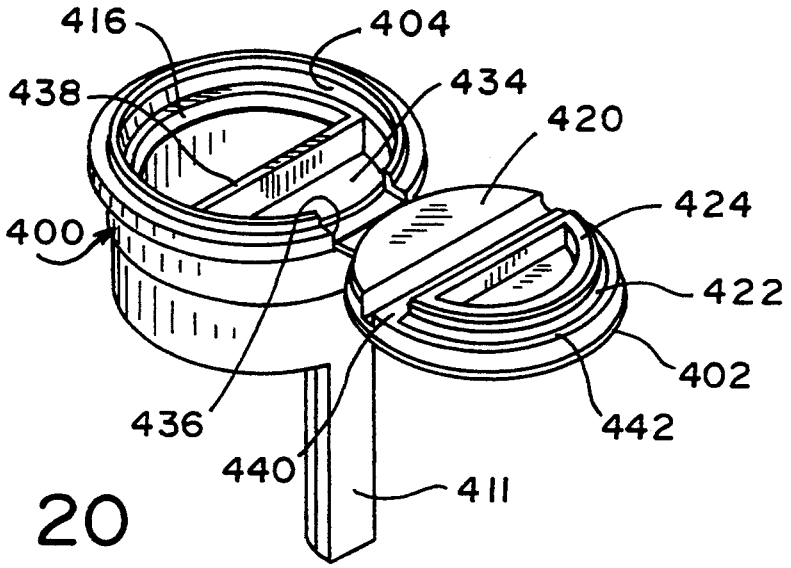
FIG. 20 is a perspective view of a closure device according to the present invention.
Figure 21:
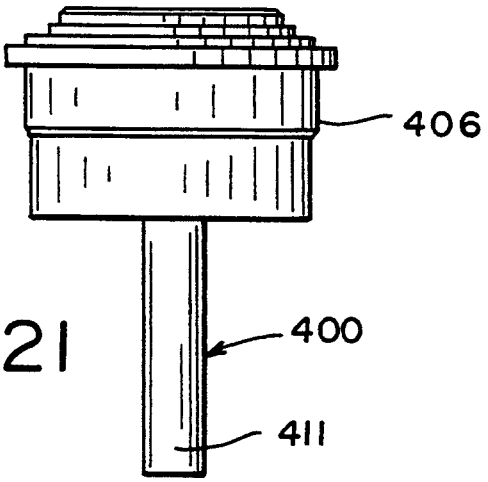
FIG. 21 is a side view of the device of FIG. 20.
Figure 22:
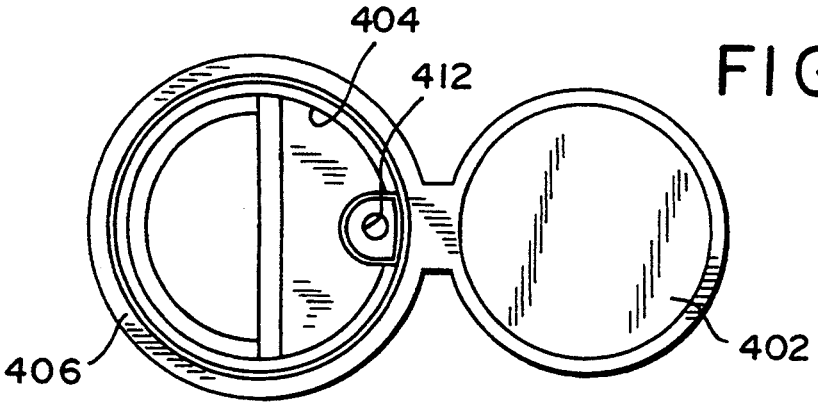
FIG. 22 is a bottom view of the device of FIG. 20.
Figure 23:
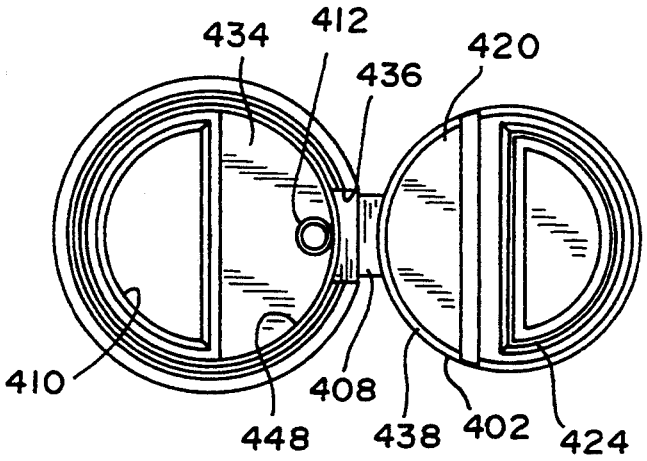
FIG. 23 is a top view of the device of FIG. 20.

FIGS. 18A and 18B illustrate a device 300 according to the present invention that has a body 302 with a fluid flow channel 304 therethrough and an air flow channel 308. A slanted portion 320 of the body 302 facilitates the emplacement of the device 300 in the neck of a liquid container. A lid 315 is connected to the body 302 by a living hinge 312, a portion of which 322 has been removed to weaken the hinge so that the force of the hinge does not inadvertently cause the lid to become disengaged from the body 312 when the lid is closing off the openings through the body. An extension 316 of the lid is held with a snap fit in a recess 324 of the body. A lip 318 of the lid is accessible in a cutout area of the body 326 when the lid is closing off the openings so that the lid can be easily moved. A recess 314 in the lid facilitates inward pushing of the lid to free the extension 316 from the recess 324 and an upstanding rib 319 of the body 302 gives the lid something to be pushed against further facilitating freeing of the lid. As shown in FIG. 19 the device 300 has been emplaced in a neck 338 of a container 340 of liquid 342. A straw 344 extending through the channel 304 and totally enclosed in the container 340 when the lid 375 is shut, is permitted to rise from the container when the lid is opened. A float member 346 may be used to facilitate the rising of the straw 344 in the container. One or more protrusions or ridges 336 on the lid 315 provide a stop or surface which can be contacted by a part of a cap or cover of a container on which the device 300 is disposed. The part of the cap or cover pushes down on the ridge 336 to insure that a seal is maintained between the lid and the body 302. This is particularly helpful if the living hinge exerts such force that it tends to raise the lid or part of it thereby reducing the sealing effect of the lid with the body. Part of a cap or cover pushing down on the ridge 336 insures or enhances the lid 315-body 302 seal. It is within the scope of this invention to have one or more of such ridges or protrusions and to have one circular protrusion-that encircles the lid.

Devices according to this invention may be made from virgin plastics or from recycled plastics; linear low density polyethylene, high density polyethylene, medium density polyethylene, polypropylene and other plastics may be used.

FIGS. 20–28 illustrate a closure device 400 according to the present invention which may be used with known prior art containers or with any container described or shown herein to form a container according to the present invention. When the device 400 is employed with a squeezable container containing fluid, manually squeezing the container produces sufficient pressure to release a lid 402 from within a recess 404, thus opening the closure device 400 to flow therethrough. The device 400 may also have a portion which can be manually pressed inwardly to release its lid.

The lid 402 of the closure device 400 is hingedly connected to a body 406 by a hinge member 408. The body 406 has a fluid pour opening 410 and an air vent opening 412. A vent extension 411 extends downwardly from the body 406 and an air vent channel 414, in communication with the air vent opening 412, extends through the air vent channel 414. Fluid may be poured from a container on which the device 400 is disposed (or on which it is integrally formed) through a fluid channel 416 which is in communication with the fluid pour opening 410.

Figure 28:
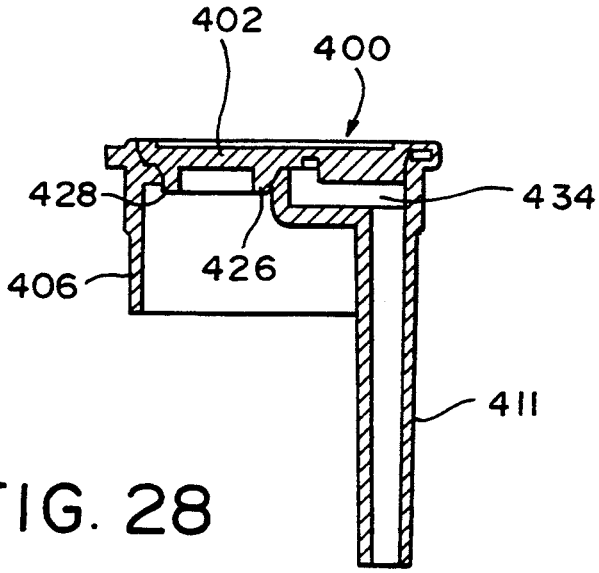
FIG. 28 is a side cross-section view of the device of FIG. 20.

The body 406 has various recesses and the lid 402 has various seal members so that effective yet releasable sealing of the lid over the fluid pour opening 410 and over the air vent opening 412 is achieved. The lid recess 404 around the top of the body 406 sealingly receives and holds a seal member 420 on the lid 402 and a seal member 422 on the lid 402. Sealing of the fluid pour opening 410 by the seal member 422 is enhanced by a seal member 424 on the lid 402 which projects into the fluid pour opening. Edges 426 and 428 of the seal member 424 project down into the fluid pour channel 416 (when the lid 402 is sealed shut as shown in FIG. 28.) sealing against interior surfaces 430 and 432 respectively of the body 406. Preferably the seal member 424 corresponds to and mates with the opening defined by the surfaces 430 and 432 for continuous sealing around the fluid pour opening 410. A bar 438 defines part of the fluid pour opening 410 and a part 440 of the lid 402 abuts the top of the bar 438. A part 442 of the lid 402 sealingly abuts a semi-circular surface 444 of the body 406.

The seal member 420 is preferably a solid raised member which projects downwardly into a cavity 434 above the air vent opening 412. This produces a stiffer lid than the lids of other devices described above. Due to a recess 450 in the lid 402, the lid can be pressed inwardly to release it from the body 406. Preferably, the device 400 is used with a container which may be squeezed to produce sufficient internal pressure to free the lid from the body 406 by squeezing alone.

Figure 24:
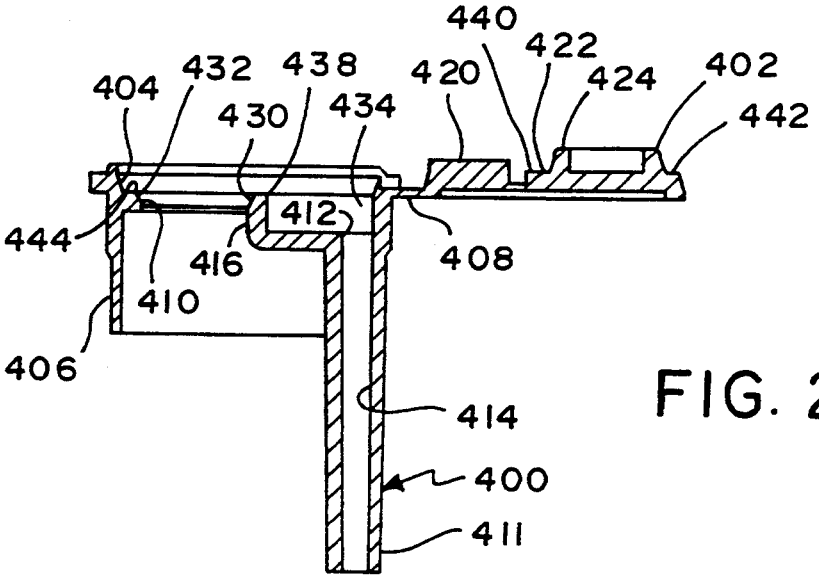
FIG. 24 is a side cross-section view along line A—A of the device of FIG. 20.
Figure 25:
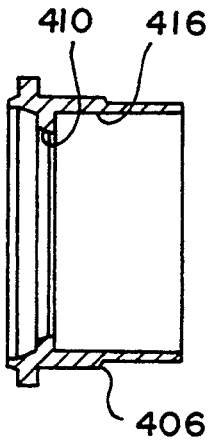
FIG. 25 is a view along line B—B of FIG. 23.
Figure 26:
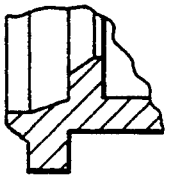
FIG. 26 is an enlarged view of the portion of the device circled in FIG. 25.
Figure 27:
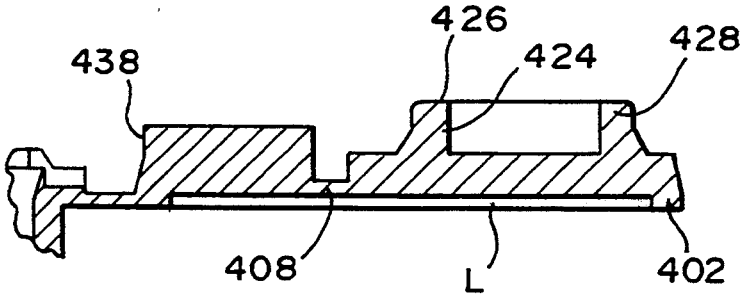
FIG. 27 is an enlarged view of the portion of the device circled in FIG. 24.

As shown in FIGS. 24, 26, and 27, the lid 402 and the body 406 are configured with various angled surfaces to facilitate release of the lid 402 from the body 406, and yet which provide sufficient frictional contact to hold the lid in place until the container is sufficiently squeezed.

When the lid 402 is in position to close off the fluid pour opening 410 and the air vent opening 412, preferably no part of the lid 402 projects above the body 406.

A hinge opening 436 through the top of the body member 406 receives the hinge 408 permitting the lid 402 to be disposed within the body 406. An edge 438 of the seal member 420 corresponds in shape to a shape 448 of the interior surface of the cavity 434 for enhanced sealing along this surface.

Preferably the air vent extension 411 extends sufficiently beyond the body 406 so that then a container with the device is tilted the fluid contents of the container will not flow out through the air vent opening.

A recess 450 in the lid 402 provides more flexibility to the lid and facilitates emplacement of the lid in the recess 404.

What is claimed is:

1. A closure device for releasably closing off an opening in a fluid container, the closure device securable at the opening, the closure device comprising a body member with a fluid flow channel therethrough, the fluid flow channel having a top fluid flow opening and a bottom fluid flow opening, the body member having an air flow opening therethrough spaced apart from the fluid flow channel, a hollow vent member having a top vent opening in fluid communication with the air flow opening and a bottom vent opening at a bottom of the hollow vent member, the hollow vent member extending beyond the bottom fluid opening and beyond the body member to inhibit egress of fluid from the container through the hollow vent member when the container is tilted, a lid connected with a hinge member to the body member for sealingly and releasably closing off the fluid flow opening and the top vent opening, the lid having a first seal member for releasably sealing shut the fluid flow channel, the lid having a second seal member for releasably sealing shut the air flow opening, a vent cavity in the body member below the air flow opening and above top vent opening of the hollow vent member and in fluid communication with the hollow vent member and with the top vent opening, the vent cavity having two ends and open at both ends for fluid flow therethrough, the second seal member comprising a solid raised member which projects downwardly into the vent cavity, and the second seal member wholly above and outside of the top vent opening of the hollow vent member when the second seal member is closing off the air flow opening, 2. The closure device of claim 1 further comprising the first seal member held by frictional force of frictional contact in the top fluid flow opening so that squeezing on the container overcomes the frictional force releasing the lid and opening the container for fluid flow therefrom.

3. The closure device of claim 1 further comprising the body member having a lid recess for receiving the lid, and the lid releasably holdable within the lid recess below a top surface of the body member.

4. The closure device of claim 3 further comprising a hinge recess in the body member for receiving the hinge member below the top surface of the body member when the lid is disposed within the lid recess.

5. The closure device of claim 3 further comprising a first recess in the lid between the first seal member and the second seal member.

6. The closure device of claim 5 further comprising the first recess in the lid disposed and configured to facilitate flexing of the lid and release of the lid from the lid recess and unsealing of the fluid flow channel and of the air flow opening upon manually pushing in on the lid.

7. The closure device of claims 1 further comprising the first seal member having a protruding member which projects into the fluid flow opening sealing against interior surfaces of the body member defining the fluid flow opening.

8. The closure device of claim 7 further comprising a bar on the body member partially defining the fluid flow opening, the bar abutting the lid when the lid is in the body member.

9. The closure device of claim 8 further comprising a first recess in the lid disposable over the hollow vent member so that manually pushing in on the lid when the lid is in the lid recess facilitates flexing of the lid and release of the lid from the lid recess and unsealing of the fluid flow channel and of the air flow opening, the lid abutting and pushing against the bar on the body member as it is pushed inwardly.

10. The closure device of claim 1 further comprising a container having a container opening in which the closure device is secured.

11. A container for containing fluid, the container comprising a container body having a container opening for the egress of fluid from the container, a closure device secured in the container opening, the closure device comprising a body member with a fluid flow channel therethrough, the fluid flow channel having a top fluid flow opening and a bottom fluid flow opening, the body member having an air flow opening therethrough spaced apart from the fluid flow channel, a hollow vent member having a top vent opening in fluid communication with the air flow opening and a bottom vent opening at a bottom of the hollow vent member, the hollow vent member extending beyond the bottom fluid opening and beyond the body member to inhibit egress of fluid from the container through the hollow vent member when the container is tilted, a lid connected with a hinge member to the body member for sealingly and releasably closing off the fluid flow opening and the top vent opening, the lid having a first seal member for releasably sealing shut the fluid flow channel, the lid having a second seal member for releasably sealing shut the air flow opening, a vent cavity in the body member below the air flow opening and above the hollow vent member and in fluid communication with the hollow vent member and with the top vent opening, the vent cavity having two ends and open at both ends for fluid flow therethrough, and the second seal member comprising a solid raised member which projects downwardly into the vent cavity, and the second seal member wholly above and outside of the top vent opening of the hollow vent member when the second seal member is closing off the air flow opening.

12. The container of claim 11 further comprising the first seal member held by frictional force of frictional contact in the top fluid flow opening so that squeezing on the container overcomes the frictional force releasing the lid and opening the container for fluid flow therefrom.

13. The container of claim 11 further comprising the body member having a lid recess for receiving the lid, the lid releasably holdable within the lid recess below a top surface of the body member, and a hinge recess in the body member for receiving the hinge member below the top surface of the body member when the lid is disposed in the lid recess.

* * * * *